US009745182B2

(12) United States Patent
Hogan

(10) Patent No.: US 9,745,182 B2
(45) Date of Patent: Aug. 29, 2017

(54) ACTUATING SYSTEM AND NOZZLES FOR LIQUID DISPENSERS

(71) Applicant: Fluid Management Operations LLC, Wheeling, IL (US)

(72) Inventor: Tim Patrick Hogan, Bristol, WI (US)

(73) Assignee: Fluid Management Operations LLC, Wheeling, IL (US)

( * ) Notice: Subject to any disclaimer, the term of this patent is extended or adjusted under 35 U.S.C. 154(b) by 131 days.

(21) Appl. No.: 14/465,293

(22) Filed: Aug. 21, 2014

(65) Prior Publication Data

US 2015/0053719 A1 Feb. 26, 2015

Related U.S. Application Data

(60) Provisional application No. 61/868,371, filed on Aug. 21, 2013.

(51) Int. Cl.
*B05B 1/30* (2006.01)
*B67C 3/26* (2006.01)
*B65B 39/00* (2006.01)

(52) U.S. Cl.
CPC ..... *B67C 3/2608* (2013.01); *B65B 39/001* (2013.01)

(58) Field of Classification Search
CPC ..... B67C 3/2608; B65B 39/001
USPC ..... 222/144.5, 559, 504, 135
See application file for complete search history.

(56) References Cited

U.S. PATENT DOCUMENTS 4,466,559 A * 8/1984 Loader ..... G07F 13/065 222/196
4,966,308 A 10/1990 Strazdins

* cited by examiner

*Primary Examiner* — Donnell Long
(74) *Attorney, Agent, or Firm* — Miller, Matthias & Hull LLP

(57) ABSTRACT

An actuator system having a stationary circular array of mechanical devices. The actuator system includes two stationary motors: one motor to rotate the actuator implement around the circular array of mechanical devices until the desired mechanical device is reached; and a second motor to rotate the actuator implement into engagement with an actuator pin of the mechanical device. A nozzle includes a three-sided or U-shaped stationary enclosure, together with a movable gate that completes the enclosure and forms an adjustable size nozzle outlet. As the gate closes after a dispense is complete, a controlled flow of residual liquid exits the nozzle outlet to avoid any additional displacement, thus preventing the undesirable effect of liquid being squeezed out of the nozzle outlet as the gate closes. Conversely, when the gate opens, this sniff back action operates in reverse, thereby filling the nozzle outlet and preventing air from filling the nozzle.

8 Claims, 14 Drawing Sheets

ACTUATING SYSTEM AND NOZZLES FOR LIQUID DISPENSERS

BACKGROUND

Technical Field

This document discloses actuating systems and nozzles for liquid dispensers. More specifically, this document discloses actuating systems for a liquid dispenser that includes a stationary and circular array of nozzles. The disclosed actuating systems are capable of moving an actuator amongst or around the circular array of nozzles before the actuating system stops the actuator at a specific nozzle. The actuating systems then rotate the actuator to open the selected nozzle.

This document also discloses nozzles for multiple liquid dispensers that feature a slider that is movable between a fully closed position and a plurality of open positions, including a fully open position. The disclosed nozzles may be equipped with a sniff back function and a reverse sniff back function that keeps the nozzle full of liquid before, during and after the opening and closing of the nozzle.

Description of the Related Art

Systems for dispensing a plurality of different liquids into a container are known. For example, systems for dispensing paint base materials and colorants into a paint container are known. These paint dispensing systems may use twenty or more different colorants to formulate a paint mixture. Each colorant is contained in a separate canister or package and typically includes its own dispensing pump. In some systems, the colorants and the respective pumps may be disposed on a rotating turntable disposed above a stationary container. In other systems, the colorants may be disposed along one or more stationary horizontal rows disposed above a container disposed on moving platform. Also, in some systems, the colorants may be dispensed through a stationary dispense manifold into a stationary container, wherein the manifold includes a plurality of nozzles.

In a turntable system, the turntable rotates so that the liquid to be dispensed is moved to a position above a stationary container that is being filled. Turntable systems require at least one motor to rotate the turntable, another motor to open and close the nozzles associated with the liquids to be dispensed and separate motors to operate each liquid pump. Further, the motors operating each pump and the canisters containing the liquids are mounted for rotation with the turntable, resulting in a complex and somewhat cumbersome design.

In liquid dispensers using one or more stationary horizontal rows, the container moves laterally to the appropriate colorant/pump for the next dispense. A motor for opening and closing the nozzles associated with each liquid must travel with the container, which also makes for a cumbersome design.

In manifold designs, the container, liquid pumps, liquid canisters and nozzles remain stationary as the liquids are sequentially or simultaneously pumped though individual nozzles held closely together by a manifold block. However, as noted above, some liquid dispensers dispense more than 20 different liquids and it is difficult to design a manifold that can accommodate so many different nozzles in a space-efficient and compact manner. Further, nozzles disposed in manifolds are prone to clogging and dripping, both of which are problematic.

One way in which the precision of a liquid dispensing system is compromised is "dripping". Specifically, a "left-over" drip may be hanging from a nozzle that was intended for a previous formulation and, with a new container in place under the nozzle, the drop of liquid intended for a previous formulation may be erroneously added to a new formulation. Thus, the previous container may not receive the desired amount of the liquid ingredient and the next container may receive too much.

To solve the drip problem, various scraper and wiper designs have been proposed to scrape any leftover material from an individual nozzle or an entire manifold block after a dispense operation is complete. However, these designs often require one or more different motors to operate the wiper element. Further, the use of a wiper or scraping function may not be practical in a multiple nozzle manifold design, as the liquids from the different nozzles will be cross-contaminated by the wiper or scraper, which would then also contribute to the lack of precision of subsequently produced formulations. Accordingly, improved nozzle designs that address the drip problem are needed.

Another problem associated with dispensing systems that make use of nozzles is clogging. Specifically, nozzle clogging may be experienced with the dispensing of relatively viscous liquids such as tints, colorants, base materials for paints and cosmetic products, certain pharmaceutical ingredients or other liquid materials having relatively high viscosities and/or volatile solvents. The viscous liquids have a tendency to dry and cake onto the end of the nozzles, thereby requiring frequent cleaning in order for the nozzles to operate effectively. For example, when a liquid or slurry material dries on a nozzle, the dispense stream may be misdirected causing the liquid or slurry to miss the container being filled. This problem is particularly prevalent in the dispensing of colorants or tints. While some mechanical wiping or scrapping devices are available, these devices are not practical for multiple nozzle manifold systems for the reasons set forth above and the scraper or wiper element must be manually cleaned anyway. Further, nozzles have also been known to clog entirely when exposed to air for an extended period, which renders wiping or scrapping devices ineffective.

Another problem associated with liquid dispensing systems is air entering the nozzle during the opening or closing of the nozzle. For example, when a nozzle is opened, air may be free to enter the nozzle outlet and consume some of the interior volume of the nozzle through which the liquid flows. Some dispensing systems may attempt to account for air in the nozzle during calibrations, but the results may be inconsistent. Other systems may require the nozzle to be primed with liquid before a dispense, which is time consuming and wasteful. Regardless, the presence of air in a nozzle compromises the accuracy of the dispense and improved nozzle designs are needed that address the air problem.

Nozzles for liquid dispensers of the type described above typically have two positions—open and closed. Because of the high degree of precision required by some applications, a nozzle design that can be opened fully or partly by a motorized mechanism would be very beneficial. Such a nozzle design would enable a fast dispense rate when in a fully open position and slower dispense rates when in partially open positions. Such an improved nozzle design would need to address the problem of air entering the nozzle between dispenses as well.

Accordingly, a need exists for improved multiple liquid dispensers and actuation systems that are less cumbersome and complex. A need also exists for improved nozzle designs that are not prone to clogging, that are not prone to allowing air into the nozzle between dispenses and that enable dispensing through the nozzle in not only a fully open position but through a plurality of partially open positions as well.

SUMMARY OF THE DISCLOSURE

In one aspect, the document discloses a method for opening and closing a nozzle outlet of a nozzle of a liquid dispenser without dripping liquid or drawing air into the nozzle. The nozzle includes a body having an interior space in communication with the nozzle outlet. The interior space provides an available volume for accommodating liquid. The nozzle outlet provides an outlet volume for accommodating liquid. The method may include:

charging the nozzle outlet and the interior space with liquid;

providing a volume compensator in liquid communication with the nozzle outlet and the interior space, the volume compensator configured to increase the available volume of the interior space when the nozzle is closed and the volume compensator further configured to decrease the available volume of the interior space when the nozzle is opened;

opening the nozzle outlet and decreasing the available volume of the interior space by a first amount about equal to an increase in the outlet volume at the nozzle outlet created by opening the nozzle outlet; and closing the nozzle outlet and increasing the available volume of the interior space by a second amount about equal to a decrease in the outlet volume at the nozzle outlet created by closing the nozzle outlet.

In another aspect, this document discloses a nozzle for liquid dispenser. The nozzle may include a hollow nozzle body including a nozzle body inlet and an outlet body with a slider passageway extending therebetween. The outlet body may terminate at a U-shaped nozzle outlet. The nozzle outlet may include a distal wall disposed between two side walls. The nozzle may further include a slider including a slider body coupled to a gate. The slider body may be slidably accommodated in the slider passageway. The gate may be slidably accommodated in the outlet body and nozzle outlet. The gate may engage the distal wall and the two side walls of the nozzle outlet when the slider shifts to a fully closed position. The nozzle outlet may be in communication with the passageway as the slider and gate moves from the fully closed position to an open position. Further, the nozzle may include a volume compensating element in communication with the passageway that decreases an available volume in the passageway for accommodating liquid as the gate is opened and that increases the available volume in the passageway for accommodating liquid as the gate is closed.

In another aspect, an actuation system for a liquid dispenser is disclosed. The disclosed actuation system may include an indexer motor coupled to an indexer drive mechanism. The indexer drive mechanism may couple to indexer wheel. The indexer wheel may carry a final wheel. The final wheel may couple to an actuator transfer wheel. The actuator transfer wheel may coaxially couple for rotation with an actuator wheel. The actuator wheel may enmesh with an actuator drive mechanism. The actuator drive mechanism may couple to an actuator motor. And, the final wheel may carry an actuator implement.

In another aspect, a disclosed actuation system may include an indexer motor coupled to an indexer drive gear. The indexer drive gear enmeshes with an indexer gear. The indexer gear carries a final gear. The final gear enmeshes with an actuator transfer gear. The actuator transfer gear coaxially couples for rotation with an actuator gear. The actuator gear enmeshes with an actuator drive gear. The actuator drive gear couples to an actuator motor. Further, the final gear may carry or otherwise be coupled to an actuator implement.

In another aspect, a disclosed liquid dispenser may include a circular array of nozzles disposed on a stationary table. Each nozzle may be in communication with its own pump and its own canister of liquid. Each nozzle may also include an actuator pin movable between a fully open position and fully closed position. The indexer motor couples to an indexer drive gear. The indexer drive gear enmeshes with an indexer gear. The indexer gear carries a final gear for imparting circular motion to the final gear above the valves. The final gear enmeshes with an actuator transfer gear. The actuator transfer gear coaxially couples to the actuator gear for rotation with an actuator gear. The actuator gear enmeshes with an actuator drive gear. The actuator drive gear couples to the actuator motor. Further, the final gear may carry or otherwise be coupled to an actuator implement.

In another aspect, a disclosed liquid dispenser may include a stationary and circular array of nozzles, wherein each nozzle may be in communication with its own pump and its own canister of liquid. The dispenser may further include an actuation system that includes an indexer motor coupled to an indexer drive gear. The indexer drive gear enmeshes with an indexer gear. The indexer gear carries a final gear. The final gear in enmeshed with an actuator transfer gear. The actuator transfer gear coaxially couples to an actuator gear for rotation with the actuator gear. The actuator gear enmeshes with an actuator drive gear. The actuator drive gear couples to an actuator motor. The final gear carries an actuator implement. Each nozzle includes a hollow nozzle body including a nozzle body inlet, an outlet body and a nozzle body sidewall that extends therebetween. Each nozzle further includes a slider that includes a slider body coupled to a gate. Each outlet body includes an outlet body that slidably accommodates the gate of its respective slider. Each outlet body terminates at a nozzle outlet. Each outlet body includes a distal wall. Each gate includes at least one distal seal that sealably engages the distal wall of its respective outlet body when its respective slider shifts to a fully closed position. Each slider body sealably and slidably engages its respective nozzle body as each slider moves from the fully close position towards a fully open position or any one of a plurality of open positions.

In another aspect, yet another nozzle for a liquid dispenser may include a nozzle body including an inlet and an outlet. The nozzle body further includes a slider passageway for slidably accommodating a slider. The slider may include a gate. The slider body includes a reduced diameter portion that is disposed between the inlet and outlet when the slider is in an open position. The outlet includes a wall that engages the gate when the nozzle is in a closed position. The slider passageway is in communication with the outlet. The slider passageway accommodates a distal end of the slider when the slider is in the open position. Said distal end of the slider at least partially withdraws from the passageway when the slider moves towards a closed position. As a result, the movement of the slider partially out of the passageway as the nozzle is closed creates available volume and/or a low-pressure region in the passageway for receiving liquid from the outlet as the gate approaches and engages the wall of the outlet. Conversely, as the gate moves away from the wall of the outlet as the nozzle opens, available volume in the nozzle outlet is created for receiving liquid from the passageway. As a result, the nozzle outlet fills with liquid and presents a liquid surface that is flush with the nozzle outlet as the gate proceeds from a closed position to any open position, including but not limited to a fully open position.

In another aspect, another nozzle for a liquid dispenser includes a nozzle body including an inlet, an outlet and a passageway extending therebetween. The passageway slidably accommodates a slider. The slider includes a slider body coupled to a gate. The outlet slidably accommodates the gate and the outlet further includes a wall. The gate sealably engages the wall of the outlet when the slider shifts to a closed position. The nozzle body includes a chamber that at least partially accommodates the slider body when the slider is in an open position. The chamber is in communication with the outlet when the slider is in the open position. The slider body at least partially departs the chamber when the slider moves from the open position to a closed position thereby, thereby creating volume in the chamber for receiving liquid from the outlet as the gate is closed. Conversely, as the gate opens, available volume is created in the nozzle outlet and the available volume in the chamber is reduced as the slider body reenters the chamber. As a result, liquid flows from the chamber into the nozzle outlet, filling the nozzle outlet with liquid so the liquid continuously presents a liquid surface that is flush with the nozzle outlet as the gate opens.

In any one or more of the embodiments described above, the indexer wheel is an indexer gear, the indexer drive mechanism is an indexer drive gear enmeshed with the indexer gear, the actuator wheel is an actuator gear, the actuator drive mechanism is an actuator drive gear enmeshed with the actuator gear, the final wheel is a final gear, and the actuator transfer wheel is an actuator transfer gear enmeshed with the final gear.

In any one or more of the embodiments described above, the indexer wheel is an indexer pulley, the indexer drive mechanism is an indexer drive pulley coupled to the indexer pulley by a first endless belt, the actuator wheel is an actuator pulley, the actuator drive mechanism is an actuator drive pulley coupled to the actuator pulley by a second endless belt, the final wheel is a final pulley, and the actuator transfer wheel is an actuator transfer pulley coupled to the final pulley by a third endless belt.

In any one or more of the embodiments described above, the indexer gear is disposed coaxially between the actuator gear and the actuator transfer gear.

In any one or more of the embodiments described above, the indexer motor and the actuator motor are linked to a controller.

In any one or more of the embodiments described above, the indexer motor and the actuator motor are stepper motors.

In any one or more of the embodiments described above, the indexer motor and the actuator motor are mounted on a platform disposed above the actuator gear and opposite the actuator gear from the indexer gear.

In any one or more of the embodiments described above, the actuator transfer gear and the final gear are disposed below the indexer gear and opposite the indexer gear from the actuator gear.

In any one or more of the embodiments described above, the actuator implement couples to an underside of the final gear and extends vertically downward therefrom.

In any one or more of the embodiments described above, the indexer gear includes indicia that are readable by an indexer gear sensor. The indicia indicate a position of the indexer gear with respect to a zero position. The indexer gear sensor links to the controller.

In any one or more of the embodiments described above, the nozzle body and outlet body are separate components and the nozzle body includes a nozzle body outlet and the outlet body includes a collar that is sealably and mateably received in the nozzle body outlet.

In any one or more of the embodiments described above, the slider body is hollow and includes a slider body inlet, a slider body outlet and a slider body sidewall extending therebetween. The slider body sidewall couples to the actuator pin.

In any one or more of the embodiments described above, the collar of the outlet body includes an inner surface that mateably, sealably and slidably receives the slider outlet. Further, the collar of the outlet body includes an outer surface that is mateably and sealably received in the nozzle body outlet.

In any one or more of the embodiments as described above, the gate includes at least one proximal seal that sealably and slidably engages the inner surface of the collar as the slider slides towards the fully closed position.

In any one or more of the embodiments as described above, the slot in the nozzle body sidewall is elongated to permit the actuator pin and the slider to be slid from a fully open position where communication is established between the nozzle body inlet and the nozzle outlet to a fully closed position where engagement of the gate against the distal wall of the outlet body blocks communication between the nozzle body inlet and the nozzle outlet.

In any one or more of the embodiments described above, the slider is slidable to a plurality of open positions between the fully open position and fully closed position while maintaining sealing engagement between the slider body outlet and the collar of the outlet body.

In any one or more of the embodiments described above, the slider couples to a slider cover that is disposed exterior of the nozzle body. The slider cover engages a compensating member. The compensating member extends through an opening in the nozzle body. The slider cover pulls the compensating member at least partially out of the nozzle body as the slider moves towards the fully closed position and the slider cover pushes the compensating member into the nozzle body as the slider moves towards the fully open position.

In any one or more of the embodiments described above, the slider cover couples to the slider by the actuator pin.

The above features, functions, and advantages are achievable independently in various embodiments or may be combined in yet other embodiments, further details of which can be seen with reference to the following description and drawings.

BRIEF DESCRIPTION OF THE DRAWINGS

For a more complete understanding of the disclosed methods and apparatuses, reference should be made to the embodiments illustrated in greater detail on the accompanying drawings, wherein.

Figure 1A:
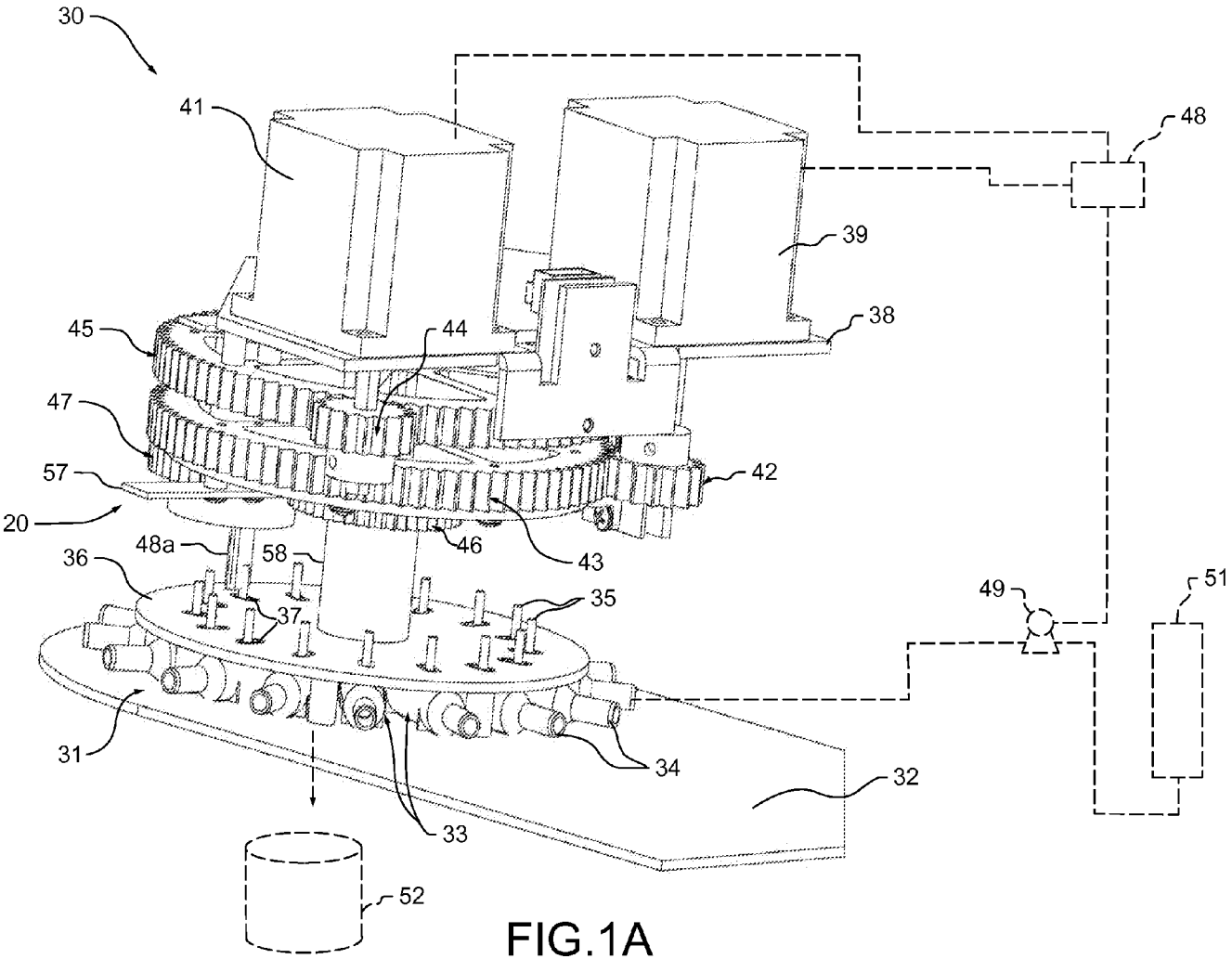
FIG. 1A is a perspective view of a disclosed liquid dispenser.

The drawings are not necessarily to scale and that the disclosed embodiments are sometimes illustrated diagrammatically and in partial views. In certain instances, details are omitted which are not necessary for an understanding of the disclosed methods and apparatuses or which render other details difficult to perceive. Further, this disclosure is not limited to the particular embodiments illustrated herein.

DETAILED DESCRIPTION OF THE PRESENTLY PREFERRED EMBODIMENTS

Turning first to FIG. 1, a dispenser 30 is disclosed which includes a stationary and circular array of nozzles 31 disposed on a table 32. The array of nozzles 31 includes a plurality of individual nozzles 33, each including an inlet 34. Each nozzle 33 also includes an actuator pin 35, the operation of which is explained below. The actuator pins 35 extend upward through a plate 36 that includes a plurality of guide slots 37 that permit the actuator pins 35 to move from a fully open position to a fully closed position and any of a plurality of open positions therebetween.

The actuator pins 35 are moved by the actuator system 20, which may be applied to any array of mechanical devices as discussed below. In short, the actuator system 20 is not limited to the opening and closing of nozzles 33, but may be used to actuate individual mechanical devices that are arranged in a circular array.

Returning to FIG. 1, a platform 38 disposed above the table 32 and the plate 36. The platform 38 supports an indexer motor 39 and an actuator motor 41. The indexer motor 39 couples to an indexer drive gear 42. The indexer drive gear 42 enmeshes with an indexer gear 43. The actuator motor 41 couples to an actuator drive gear 44. The actuator drive gear 44 enmeshes with an actuator gear 45.

Figures 1B, 2B:
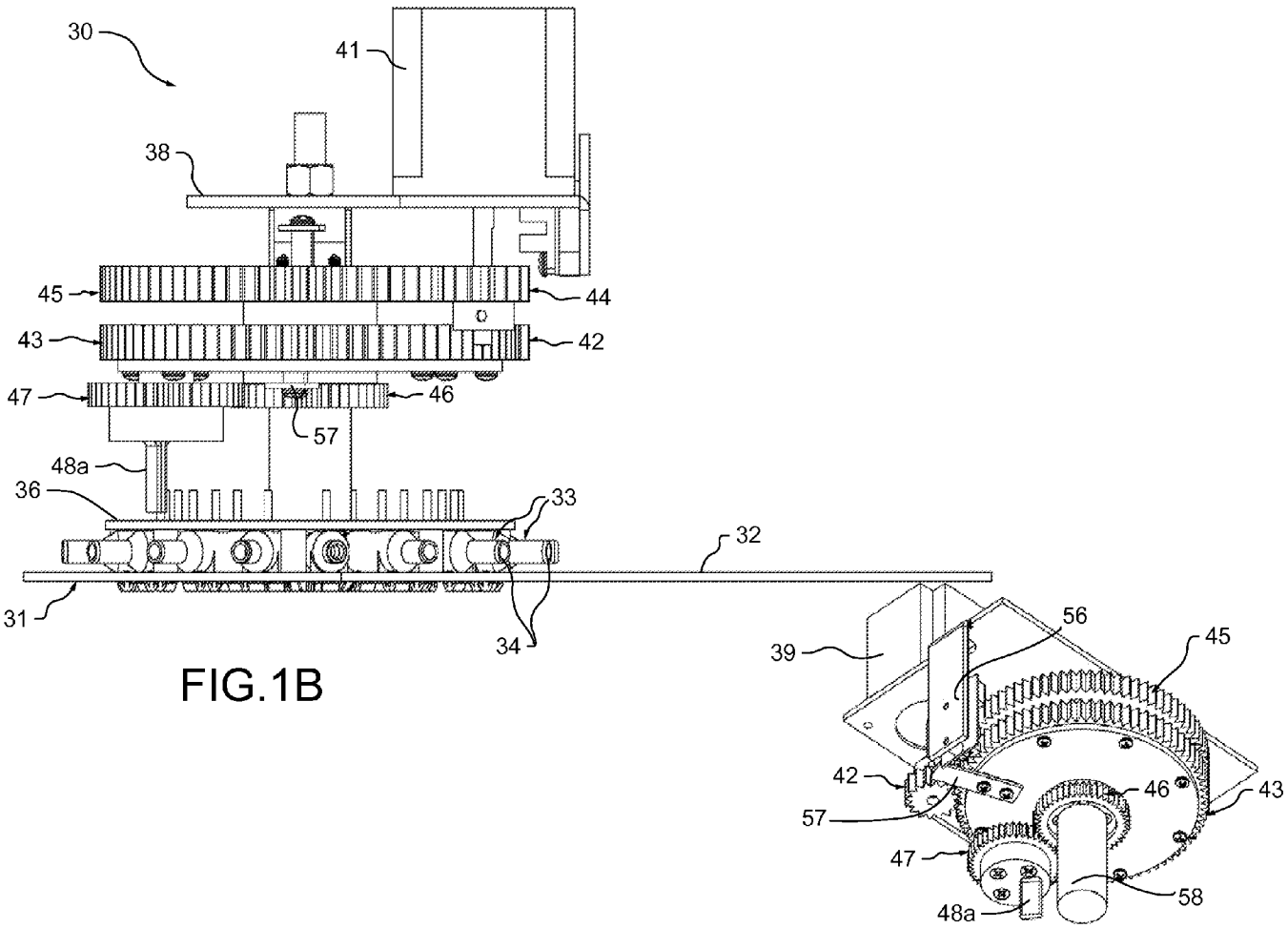
FIG. 1B is a plan view of the dispenser shown in FIG. 1B.
FIG. 2B is a partial bottom perspective view of the liquid dispenser shown in FIGS. 1A-1B and FIG. 2A.

The actuator gear 45 connects to an actuator transfer gear 46 that, as shown in FIG. 1B, enmeshes with a final gear 47. The final gear 47 couples to or otherwise carries an actuator implement 48*a* that, as discussed in greater detail below, is used to move the actuator pins 35 between various open positions and a fully closed position. The actuator implement 48*a* may be in the form of a blade, fork or other structure that is appropriate for actuating the mechanical devices. In the example of FIGS. 1A and 1B, the actuator implement 48*a* is a blade, which is useful for individually engaging the actuator pins 35. However, because the actuation system 20 is applicable to mechanical devices other than nozzles 33, the structure of the actuator implement 48*a* may vary, as will be apparent to those skilled in the art.

As shown schematically FIG. 1A, the indexer motor 39 and the actuator motor 41 link to a controller 48. Further, the inlet 34 of each nozzle 33 connects to its own pump 49 that is in communication with its own canister 51. The pumps 49 associated with each nozzle 33 also link to the controller 48. The inlets 34 to the nozzles 33 extend radially outwardly and, accordingly, the disclosed nozzles 33 are disposed radially inwardly from the view of FIG. 1A and further extend downward through a central opening 40 (FIG. 2C) for depositing dispensed liquids into the container 52 shown in FIG. 1A. In the example shown in FIG. 2C, each nozzle 33 may include an outlet body 54 and/or a distal nozzle outlet 55 (see also FIG. 2D) that is directed downwardly as also illustrated in FIG. 1A.

Figure 2C:
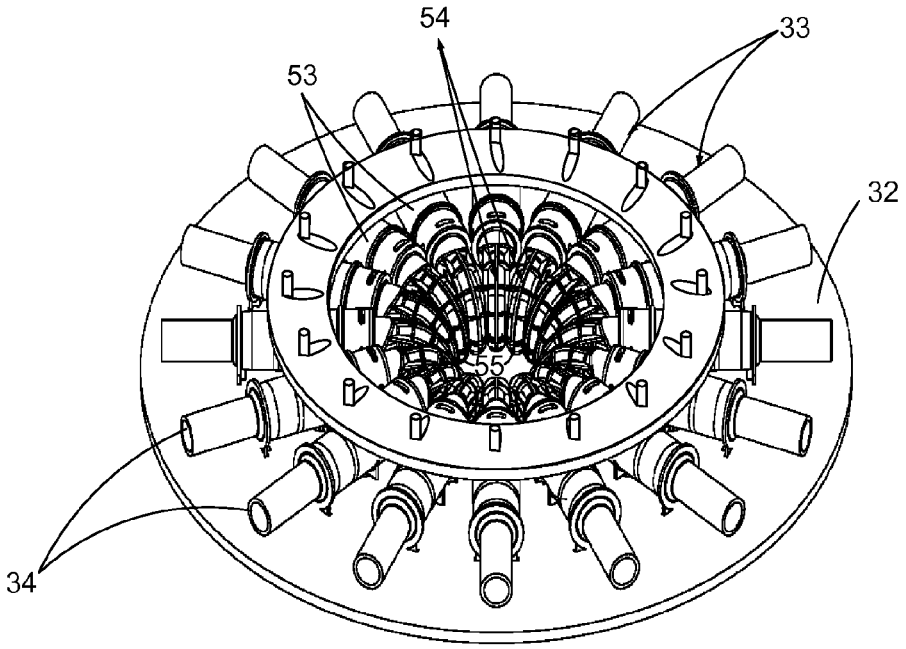
FIG. 2C is a partial perspective view of the liquid dispenser shown in FIGS. 1A-1B and FIGS. 2A-2B, particularly illustrating the outlet bodies of the disclosed nozzles directed downward through a center of the liquid dispenser.
Figure 2D:
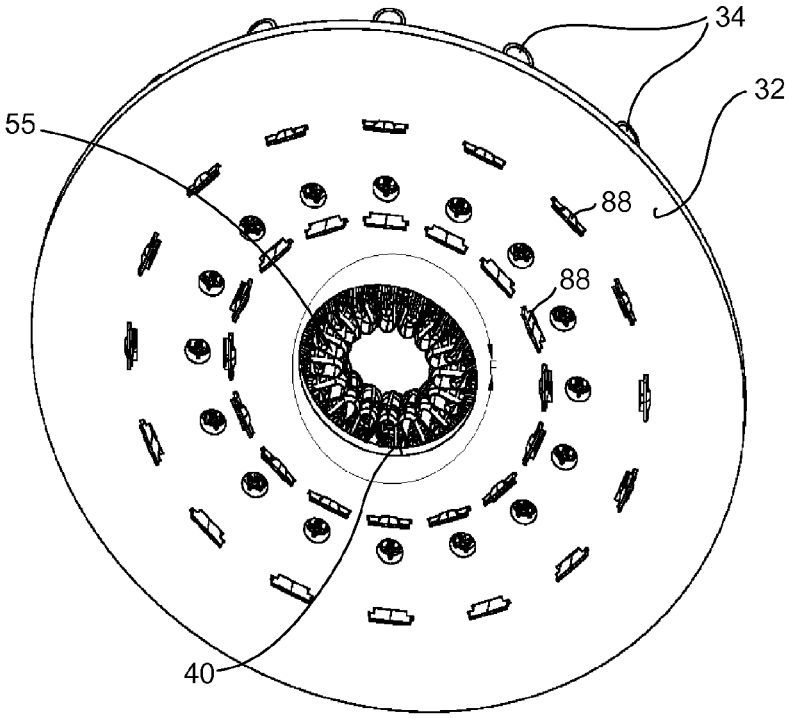
FIG. 2D is a partial perspective view of the liquid dispenser shown in FIGS. 1A-1B and FIGS. 2A-2C, particularly illustrating a bottom view of the outlet bodies that are also shown in FIG. 2C.
Figure 2A:
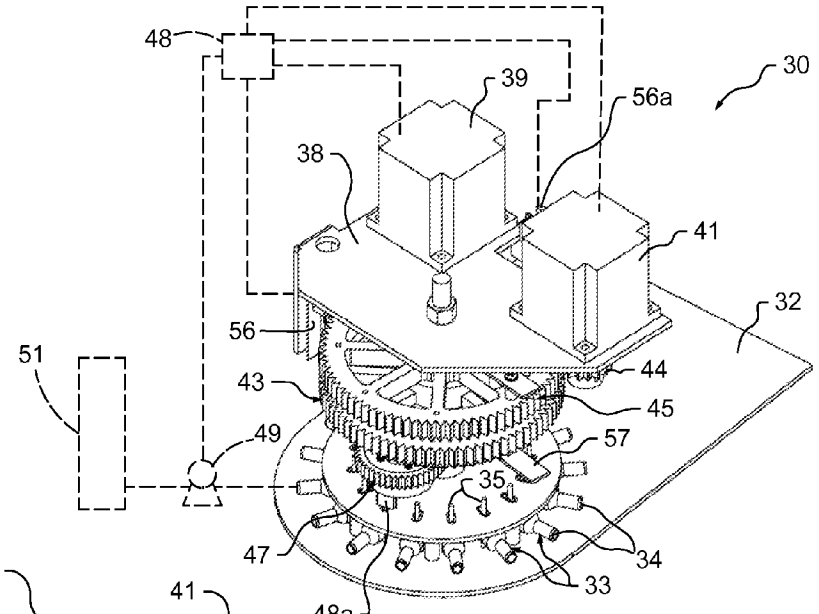
FIG. 2A is a perspective view of the liquid dispenser shown in FIGS. 1A-1B.
Figure 3:
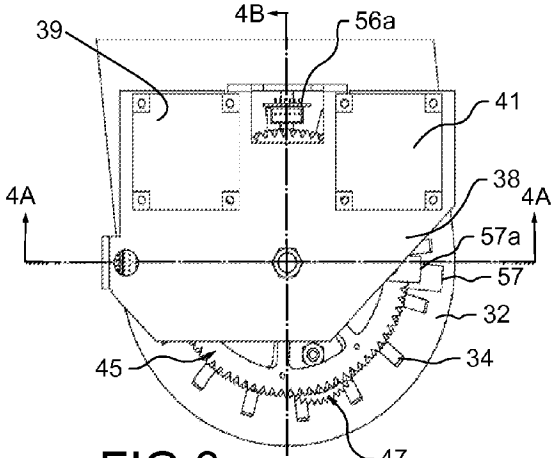
FIG. 3 is a top plan view of the liquid dispenser shown in FIGS. 1A-1B and FIGS. 2A-2C.

Turning to FIG. 2A, the dispenser 30 may further include an indexer gear sensor 56 for detecting the position of the indexer gear 43 with respect to a zero reference position. Further, the dispenser 30 may include an actuator gear sensor 56*a* for detecting the position of the actuator gear 45 with respect to a zero reference position. The indexer gear sensor 56 and actuator gear sensor 56*a* link to the controller 48. See FIG. 2B for another view of the indexer gear sensor 56 and FIG. 3 for another view of the actuator gear sensor 56*a*. As shown in FIG. 3, the flag or tab 57 may indicate a zero reference position for the indexer gear 43 and the tab 57*a* may indicate a zero reference position for the actuator gear 45.

Figure 4A:
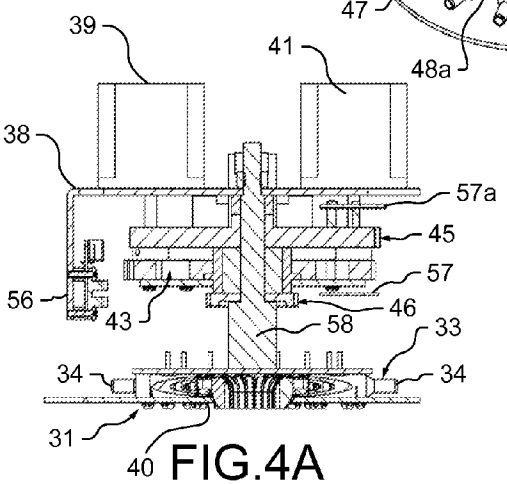
FIG. 4A is a sectional view taken substantially along line 4A-4A of FIG. 3
Figure 4B:
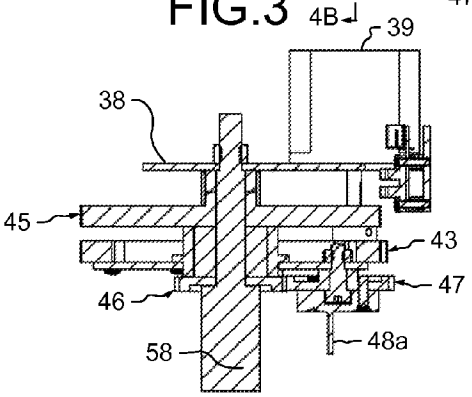
FIG. 4B is a partial section of view taken substantially along line 4B-4B of FIG. 3.
Figure 5A:
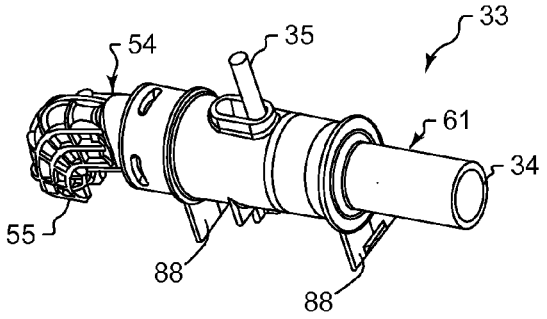
FIG. 5A is a perspective view of a disclosed nozzle.
Figure 6A:
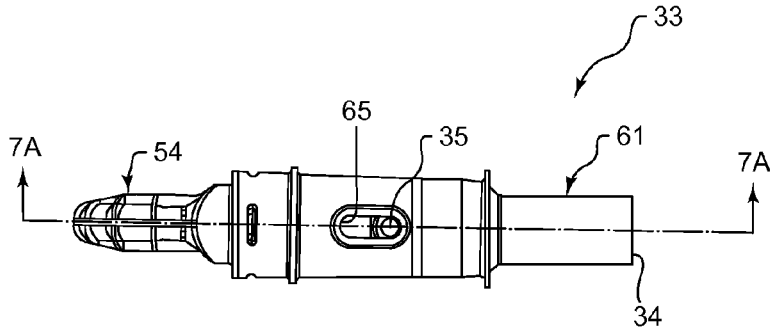
FIG. 6A is a top plan view of the nozzle shown in FIG. 5A.

FIGS. 4A-4B illustrate a spindle 58 about which the indexer gear 43, actuator gear 45 and actuator transfer gear 46 rotate. As shown in FIGS. 4A-4B the spindle 58 also supports the platform 38. The tabs 57, 57*a* for the sensors 56, 56*a* and the central opening 40 through which the nozzle outlets 55 extend are shown in FIG. 4A.

Referring to FIGS. 1A-1B and 2A-2B, in operation, the actuator implement 48*a* moves to the selected nozzle 33 of the circular array of nozzles 31 by rotating the indexer gear 43. To rotate the indexer gear 43, the controller 48 activates the indexer motor 39 and an instruction from the controller 48 causes the indexer motor 39 to rotate the indexer drive gear 42 the requisite number of rotations (or a partial rotation) to cause the indexer gear 43 to rotate about the spindle 58 until the final gear 47 and actuator implement 48*a* are disposed radially outside of the selected nozzle 33 and its actuator pin 35. In some embodiments, depending upon the design of the dispenser 30, the actuator implement 48*a* may be rotated about the spindle 58 from a position radially inside of the actuator pins 35. Using the indexer gear sensor 56 and the zero point reference tab 57, one skilled in the art will appreciate that the indexer gear 43 can be rotated so that the actuator implement 48*a* is in position adjacent to a selected actuator pin 35 associated with a selected nozzle 33. To keep the final gear 47 and the actuator implement 48*a* from rotating with respect to the indexer gear 43 as the indexer gear 43 rotates about the spindle 58, the actuator transfer gear 46 must rotate with the indexer gear 43 because the actuator transfer gear 46 is enmeshed with the final gear 47 and the final gear 47 is tethered to the indexer gear 43. If the actuator transfer gear 46 and actuator gear 45 are not rotated with the indexer gear 43, the final gear 47 will rotate as it circles around the actuator transfer gear 46, which may result in the actuator implement 48*a* inadvertently engaging one or more actuator pins 35. Therefore, once the actuator implement 48*a* is positioned to rotate about the spindle 58 without engaging (unintentionally) any of the actuator pins 35, that position may be held by rotating the actuator gear 45 and the actuator transfer gear 46 with the indexer gear 43 while the indexer gear 43 rotates to the selected nozzle 33. Thus, to rotate the final gear 47 and the actuator implement 48*a* to a nozzle 33 of choice without rotating the actuator implement 48*a* with respect to the indexer gear 43, the controller 48 sends a signal to the indexer motor 39 and the actuator motor 41 to impart an identical number of rotations to the indexer drive gear 42 and the actuator drive gear 44 (or the appropriate ratio if the gear ratio of the indexer gear 43 and the actuator gear 45 is not 1:1). Once the final gear 47 and actuator implement 48*a* reach the desired nozzle 33, the final gear 47 and actuator implement 48*a* may be rotated to open or close the actuator pin 35 of the selected nozzle 33 by the controller 48 sending a signal to the actuator motor 41 to impart the desired number of rotations to the actuator drive gear 44 which, in turn causes the actuator gear 45 and the actuator transfer gear 46 to rotate. Due to the engagement between the actuator transfer gear 46 and the final gear 47, rotation of the actuator transfer gear 46 imparts rotation to the final gear 47, thereby causing the actuator implement 48*a* to rotate and either push and actuator pin 35 radially inwardly towards its fully closed position or pull the actuator pin 35 radially outwardly through a plurality of open positions towards the fully open position. Thus, by rotating the actuator motor 41 or the actuator drive gear 44 and the actuator gear 45 while holding the indexer motor 39, indexer drive gear 42 and indexer gear 43 stationary, the resulting motion causes rotation of the final gear 47 and actuator implement 48*a* while the indexer gear 43 remains stationary. The sensor 56*a* and tab 57*a* may be used to identify the starting and ending positions of the actuator implement 48*a* and the final gear 47.

It will be noted that the dispenser 30 features a design where both motors 39, 41, along with various motors driving the pumps 49 remain stationary thereby avoiding problems with mounting the motors 39, 41 on moving parts or platforms. Placing the motors 39, 41 on moving platforms presents problems associated with cabling and providing power to the motors 39, 41.

It will also be noted that the indexer gear 43, indexer drive gear 42, actuator gear 45, actuator drive gear 44, actuator transfer gear 46 and final gear 47 may be wholly or partly replaced by a belt drive transmission.

Figure 7A:
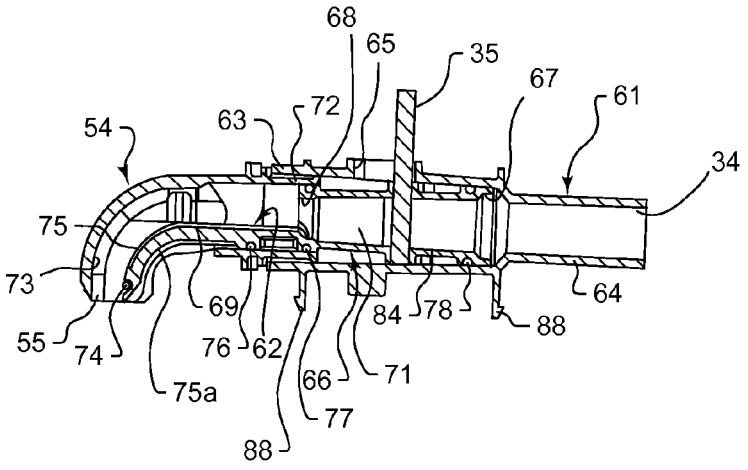
FIG. 7A is a sectional view taken substantially along line 7A-7A of FIG. 6A.
Figure 5B:
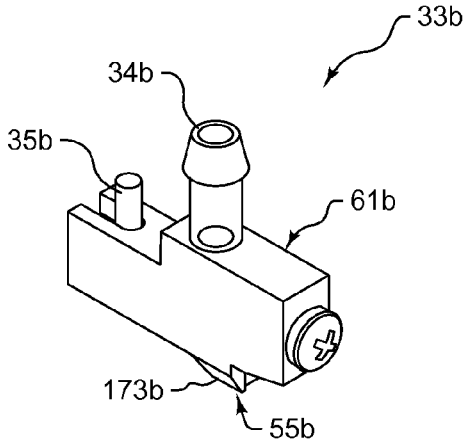
FIG. 5B is a perspective view of another disclosed nozzle.
Figure 6B:
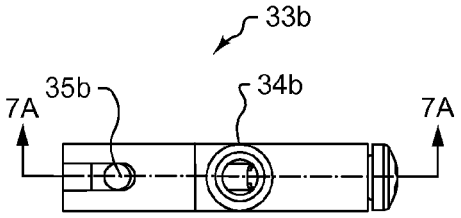
FIG. 6B is a top plan view of the nozzle shown in FIG. 5B.

FIGS. 5A-7A illustrate one disclosed nozzle 33. The nozzle 33 may include a nozzle body 61 including an inlet 34 (see also FIG. 1A), an outlet body 54 and a slider 62 (not visible in FIGS. 5A-6A; see FIG. 7A). The nozzle body 61 and outlet body 54 may be unitary in structure. As shown in FIG. 7A, the nozzle body 61 includes an inlet 34 and an outlet 63 with a through passageway extending therebetween. The nozzle body 61 further includes a sidewall 64 that includes a slot 65. The slot 65 accommodates the actuator pin 35 that couples to the slider 62. The slider 62 may include a slider body 66 that may be cylindrical (or somewhat cylindrical) or that may include an inlet 67 and an outlet 68. The outlet 68 of the slider body 66 connects to a gate 69. The gate 69 is slidably received in the outlet body 54. The outlet body 54 may connects to a collar 72 that is mateably received in the outlet 63 of the nozzle body 61 if the two parts are not unitary. Further, the collar 72 may mateably receive the outlet 68 of the slider body 66 as shown in FIG. 7A.

In FIG. 7A, the slider 62 or gate 69 is in the fully open position. Liquid may enter the nozzle 33 through the inlet 34 of the nozzle body 61 and proceed through the inlet 67 of the slider body 66 before proceeding through the outlet 68 of the slider body 66 before entering the outlet body 54 and exiting the nozzle 33 through the nozzle outlet 55. In the open position shown in FIG. 7A, a through passageway 71 is established between the inlet 34 and the nozzle outlet 55.

Figure 18:
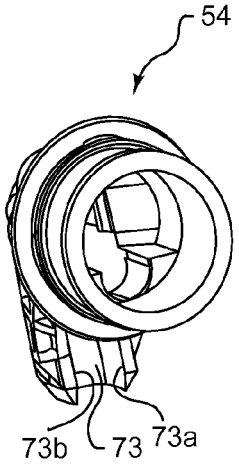
FIG. 18 is an end perspective view of an outlet body of the nozzle illustrated in FIGS. 5A-7A.
Figure 19:
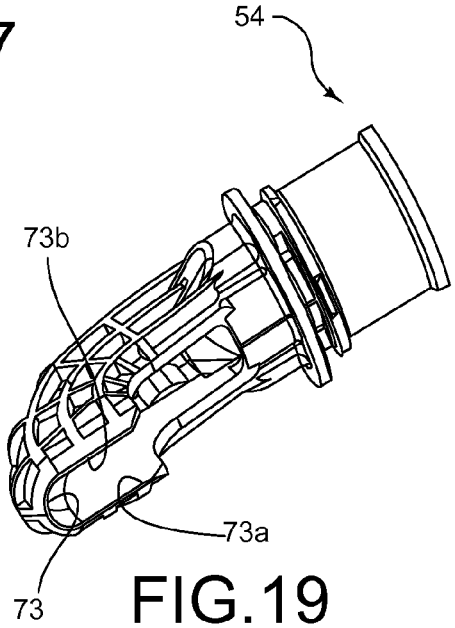
FIG. 19 is a bottom perspective view of the outlet body shown in FIG. 18.
Figure 20:
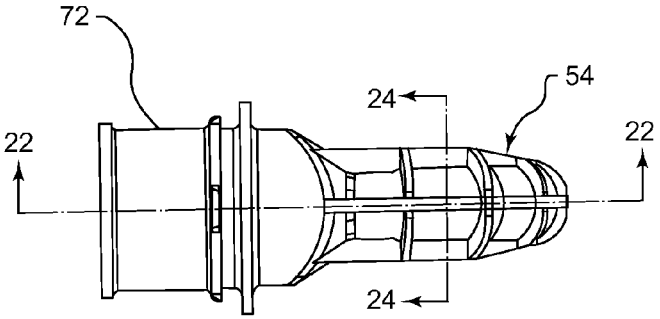
FIG. 20 is a top plan view of the outlet body shown in FIGS. 18-19.
Figure 21:
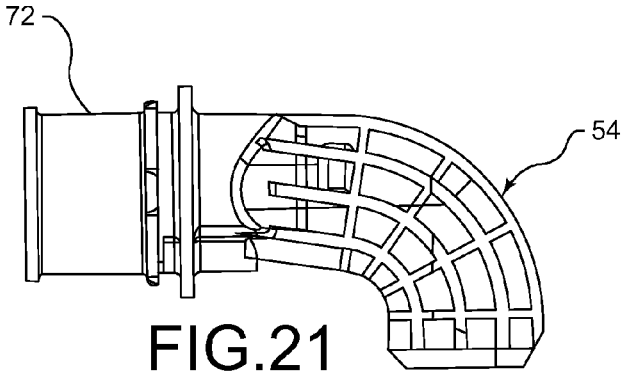
FIG. 21 is a side plan view of the outlet body shown in FIGS. 18-20.
Figure 22:
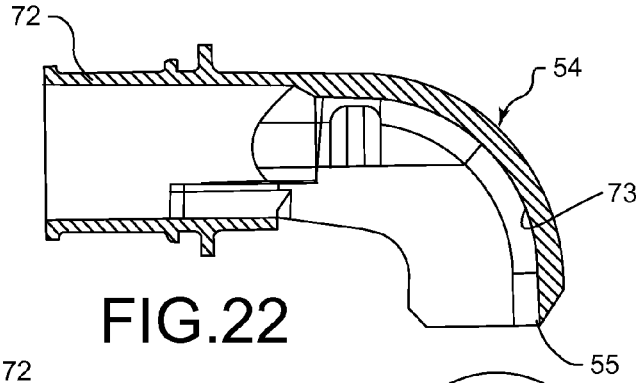
FIG. 22 is a sectional view taken substantially along line 22-22 of FIG. 20.
Figure 23:
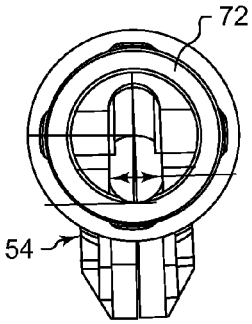
FIG. 23 is an end view of the outlet body shown in FIGS. 18-22.
Figure 24:
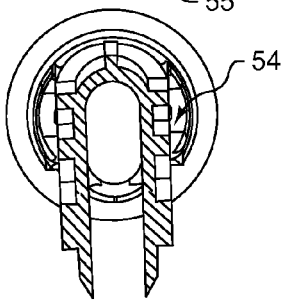
FIG. 24 is a sectional view taken substantial taken along line 24-24 of FIG. 20.

To close the nozzle 33, the actuator implement 48*a* engages the actuator pin 35 and shifts the actuator pin 35 to the left in FIG. 7, thereby causing the gate 69 to engage the distal wall 73 of the outlet body 54. The gate 69 may include one or more seal members, such as a first seal member 74, a second seal member 75 and a third seal member 75*a* to effectuate a seal between the gate 69, the distal wall 73 and the side walls 73*a*, 73*b* (see FIGS. 18-19). Conversely, one or more seals may be disposed on the distal wall 73 and side walls 73*a*, 73*b*. Meanwhile, the slider body 66 may include a fourth seal member 76 and a fifth seal 77 that provide sealing engagement between the slider 62 and the interior surface of the collar 72 of the outlet body 54. Still further, the inlet 67 of the slider body 66 may also include a sixth seal member 78, which prevents liquid entering the inlet 34 from migrating between the slider body 66 and an interior surface of the nozzle body 61.

Still referring to FIG. 7A, when the slider 62 is moved to the closed position (to the left in FIG. 7A), liquid disposed at or inside of the nozzle outlet 55 is squeezed or drawn upward into the outlet body 54 by the action of the gate 69 approaching the distal wall 73 in combination with the action of the slider body 66 and slider body inlet 67 moving away from the nozzle inlet 34. As the gate 69 engages the distal wall 73 and the slider body 66 moves left in FIG. 7A, liquid is sucked from the nozzle outlet 55 and directed towards and through the slider body inlet 67 and into the nozzle body 61 or through passageway 71. This sucking or sniff back action occurs because the "available volume" inside the nozzle body 61 increases as the slider body 66 moves to the left in FIG. 7A, or towards the outlet body 54. By designing the nozzle body 61, slider 62 and outlet body 54 in this way, a built-in sniffback feature is provided which eliminates the problem of a droplet disposed at the nozzle outlet 55 being pushed out of the nozzle outlet 55 and into the container 52 (FIG. 1A). Instead, any lingering liquid at the nozzle outlet 55 is sucked upwards into the nozzle 33 as the nozzle 33 is closed. Importantly, a reverse phenomenon occurs when the nozzle 33 of FIGS. 5A-7A is opened.

Specifically, as the nozzle 33 is opened by moving the gate 69 away from the distal wall 73, liquid disposed in the through passageway 71 is drawn towards the nozzle outlet 55 because the available volume at the nozzle outlet 55 increases and the available volume in the through passageway 71 decreases as the slider body 66 moves towards the inlet 34 and farther into the nozzle body 61. Further, the increase in available volume at the nozzle outlet 55 is equal to or about equal to the decrease in volume experienced in the through passageway 71 as the slider body 66 moves back into the nozzle body 61 and towards the inlet 34. By balancing these volumes, the reverse action that occurs when the nozzle 33 is opened prevents air from entering the nozzle outlet 55 as the gate 69 is opened. In addition, a fresh supply of liquid is disposed in the nozzle outlet 55 each time the gate 69 is opened. As a result, when the gate 69 is opened, a fresh supply of liquid is disposed inside the nozzle outlet 55 that presents a liquid surface that is flush or essentially flush with the nozzle outlet 55. Therefore, each time the gate 69 is opened before a dispense, the nozzle outlet 55 or outlet body 54 is charged with liquid and not air. This action enhances the accuracy of the dispenser 30 because the nozzle 33 is always full of liquid without substantial pockets of air, which would compromise the accuracy of a volumetric dispense. Further, the flush liquid surface presented at nozzle outlet 55 is predictable and repeatable.

Figure 7B:
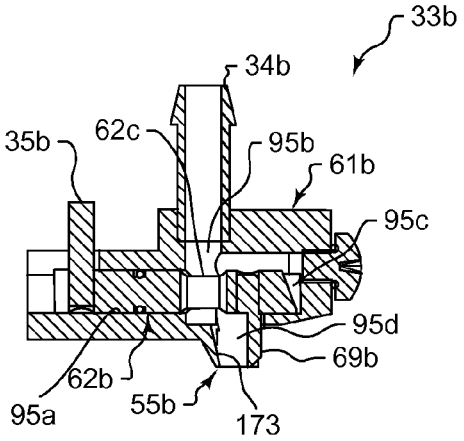
FIG. 7B is a sectional view taken substantially along line 7B-7B of FIG. 6B.
Figure 8:
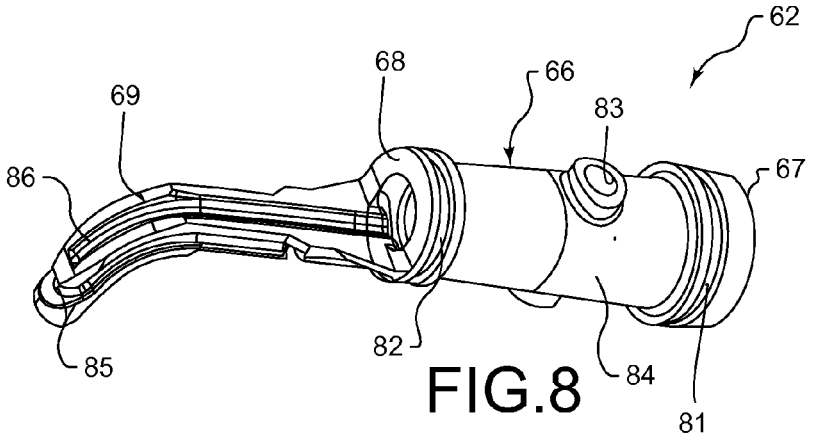
FIG. 8 is a perspective view of a slider of the nozzle shown in FIGS. 5A-7A.
Figure 9:
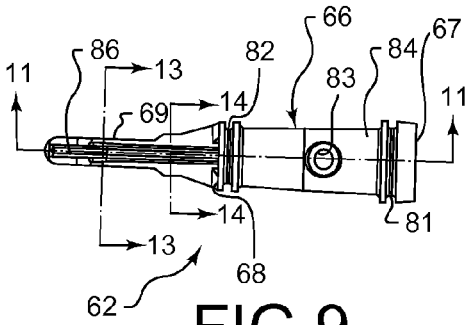
FIG. 9 is a top plan view of the slider shown in FIG. 8.
Figure 12:
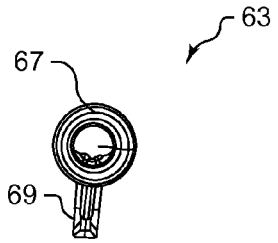
FIG. 12 is an end view of the slider shown in FIGS. 8-11.
Figure 10:
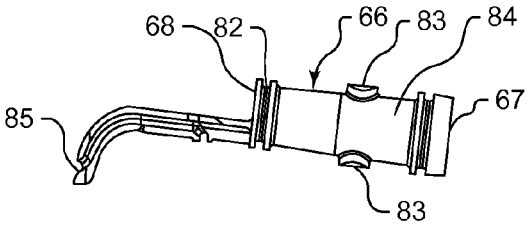
FIG. 10 is a side plan view of the slider shown in FIGS. 8-9.
Figure 13:
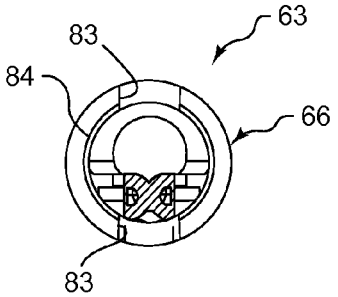
FIG. 13 is a sectional view taken substantially along the line 13-13 of FIG. 9.
Figure 11:
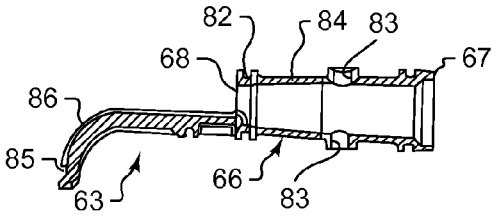
FIG. 11 is a sectional view taken substantially along line 11-11 of FIG. 9.
Figure 14:
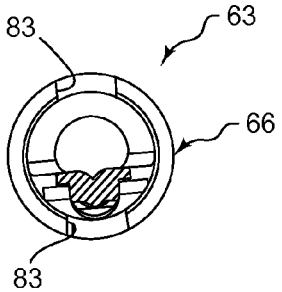
FIG. 14 is a sectional view taken substantially along line 14-14 of FIG. 9

FIGS. 5B-7B illustrate another nozzle 33*b*. The nozzle 33*b* includes a nozzle body 61*b* including an inlet 34*b*, an outlet 55*b*, a slider passageway 95*a*, a slider 62*b* (see FIG. 7B). The outlet 55*b* includes a distal wall 173 and a pair of side walls 173*b*, only one of which can be seen in FIG. 5B. As shown in FIG. 7B, the nozzle body 61*b* includes a through passageway 95*b* between the inlet 34*b* and the outlet 55*b*. In FIG. 7B, the nozzle 33*b* is in an open position with a reduced diameter portion 62*c* of the slider 62*b* disposed in the passageway 95*b* between the inlet 34*b* and the outlet 55*b*. The slider 62*b* also includes a gate 69*b*. When the nozzle 63*b* is closed, the slider 62*b* is drawn to the left in FIG. 7B until the gate 69*b* engages the wall 73*b* of the outlet 55*b*. This action expands the available volume of the chamber 95*c* by an amount about equal to the volume of the chamber 95*d* formed by the gate 69*b* and wall 73*b* when the nozzle 33*b* is in the open position. As a result, any liquid disposed at the outlet 54*b* or in the chamber 95*d* when the slider 62*b* begins a closing movement will be sucked up into the chamber 95*c* as opposed to being squeezed out of the nozzle 33*b* or out of the nozzle outlet 55*b*. Accordingly, like the nozzle 33 of FIGS. 5A-7A and 8-24, the nozzle 33*b* also includes a built-in sniff back function. Further, when the nozzle 33*b* is opened, the available volume in the chamber 95*c* shrinks as the gate 69*b* moves from a position against the wall 73*b* to the position shown in FIG. 7B. This action causes liquid in the chamber 95*c* to flow into the nozzle outlet 55*b* to form a supply of liquid in the nozzle outlet 55*b* that presents a surface that is flush with the nozzle outlet 55*b*.

Turning to FIGS. 8-14, details of the slider 62 of the nozzle 33 are illustrated. Beginning with FIG. 8, the slider body 66 includes a groove 81 disposed near the inlet 67 for accommodating the seal member 78 (see FIG. 7) and the groove 82 near the outlet 68 for purposes of accommodating the seal member 77 (see FIG. 7). At least one opening 83 may be disposed in the slider body 66 for accommodating the actuator pin 35. For structural stability purposes, two openings 83 may be diametrically oppositely disposed in the sidewall 84 of the slider body 66 as illustrated in FIG. 7. Turning to the gate 69, the groove 85 accommodates the seal member 74 and the groove 86 accommodates the seal member 75.

Figure 15:
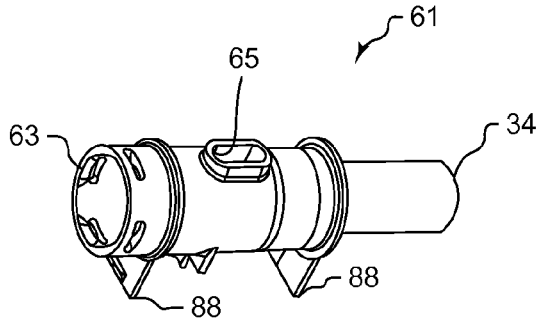
FIG. 15 is a perspective view of the nozzle body of the nozzle illustrated in FIGS. 5A-7A.
Figure 16:
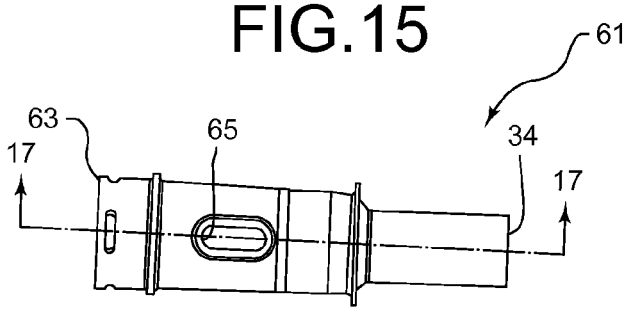
FIG. 16 is a top plan view of the nozzle body shown in FIG. 15.
Figure 17:
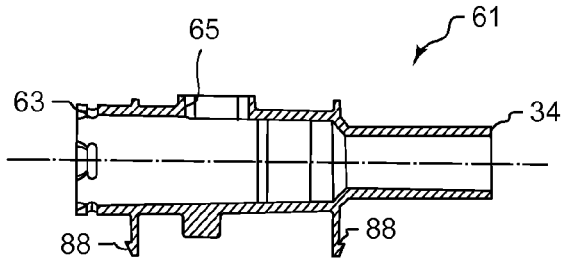
FIG. 17 is a sectional view taken substantially along line 17-17 of FIG. 16.

FIGS. 15-17 illustrate details of the nozzle body 61 of the nozzle 33. The legs 88 may secure the nozzle body 61 and the nozzle 33 to the table 32 as illustrated in FIGS. 2C-2D. Details of the outlet body 54 are provided in FIGS. 18-24. The reader will note, from FIG. 22, that there is no proximal wall opposite the nozzle outlet 55 from the distal wall 73. Such a structure is not necessary as the seal members 76, 77 and the engagement of those seal members 76, 77 with the collar 72 of the outlet body 54 prevent liquid from leaking beneath the gate 69 of the slider 62.

Figure 25:
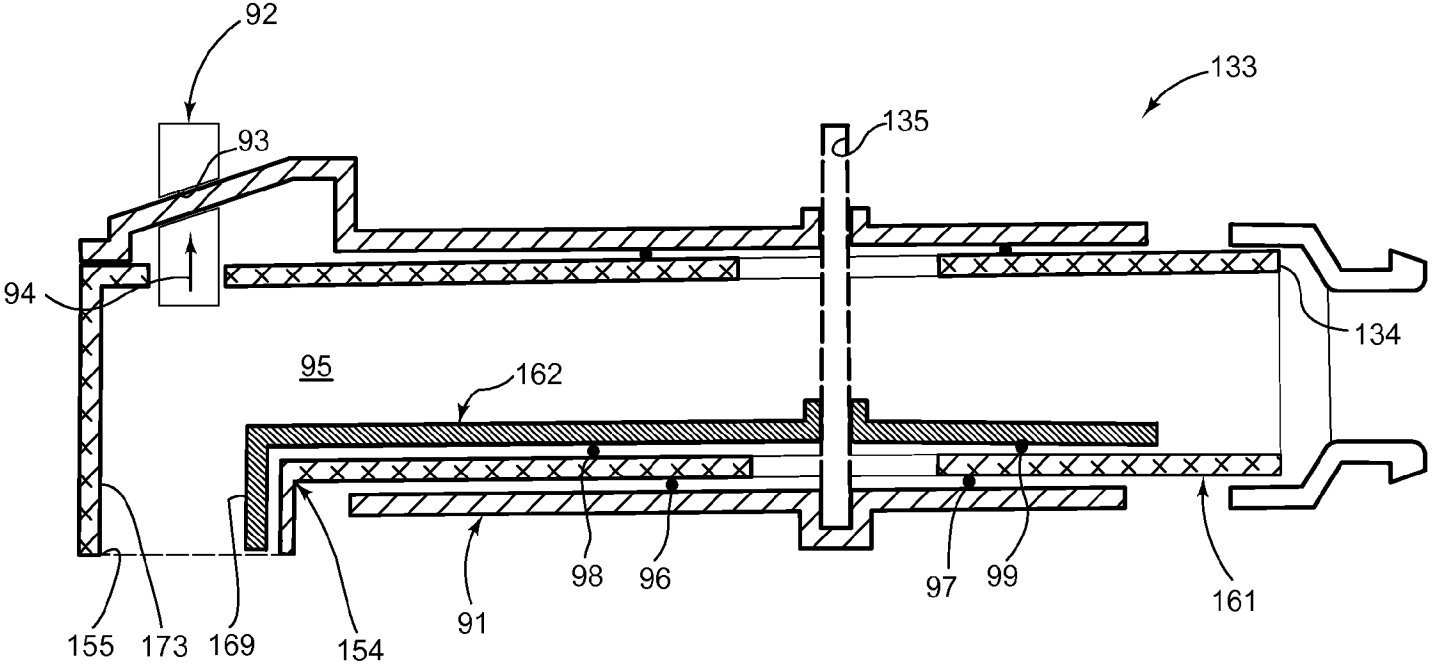
FIG. 25 is a sectional view of an alternative nozzle made in accordance with this disclosure.
Figure 26:
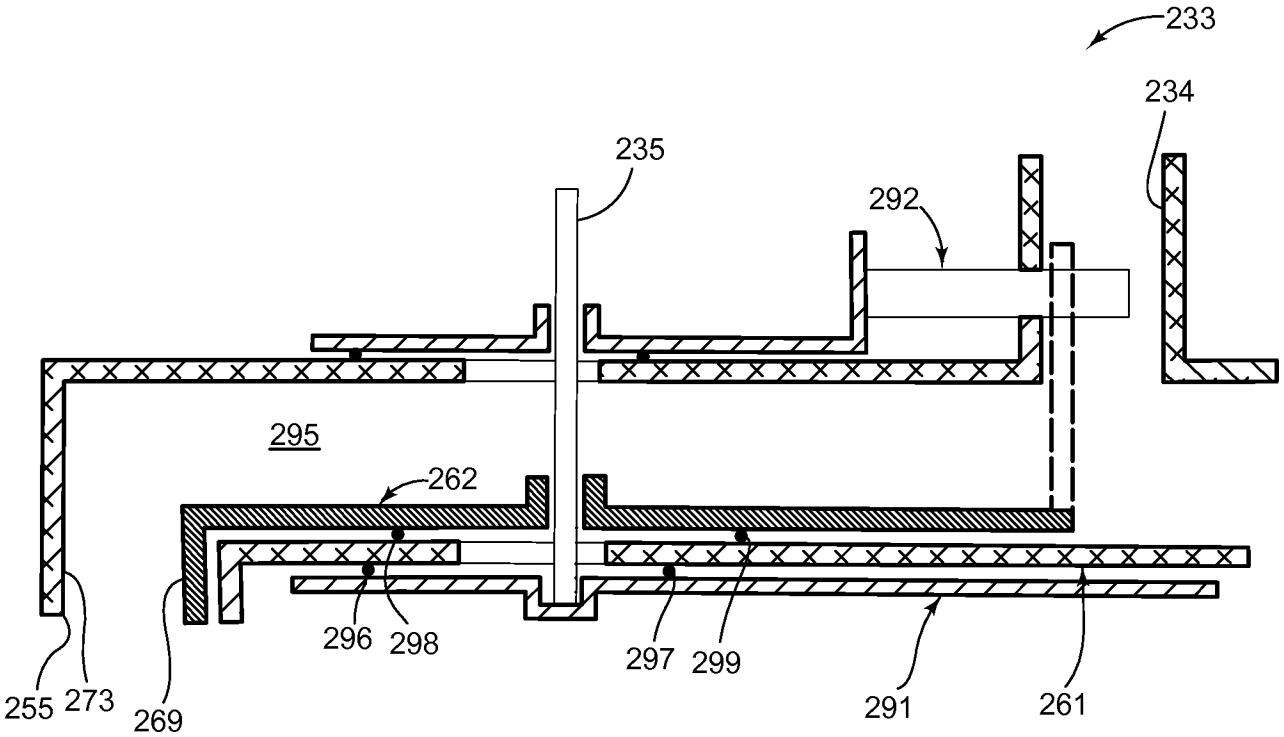
FIG. 26 is a sectional view of yet another alternative nozzle made in accordance with this disclosure.
Figure 27:
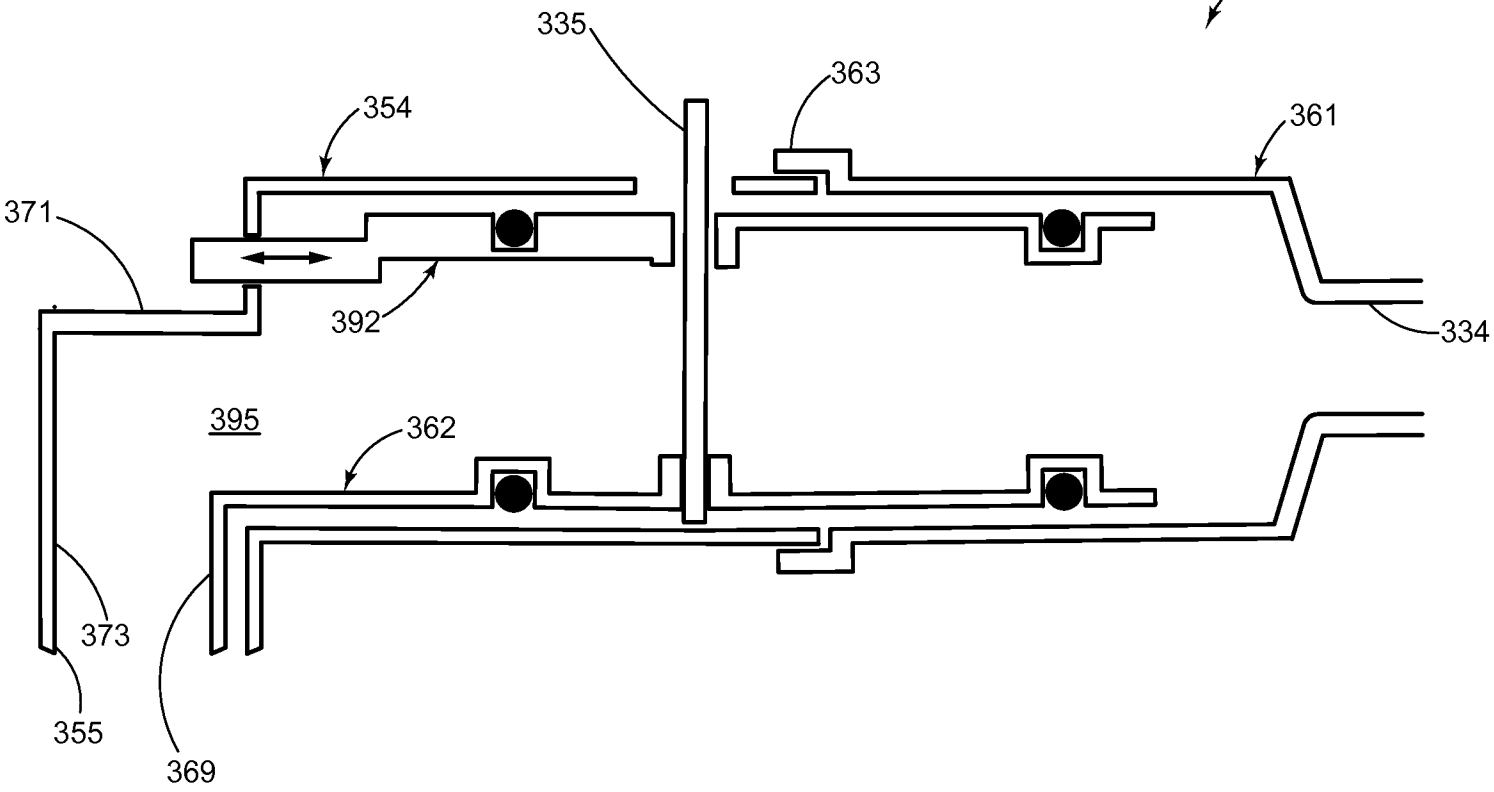
FIG. 27 is yet another alternative nozzle made in accordance with this disclosure.

FIGS. 25-27 illustrate three additional nozzles 133, 233, 333 respectively that also balance available volumes for receiving liquid when the nozzles are opened and closed. In FIG. 25, the nozzle 133 includes a stationary nozzle body 161 that includes or connects to an inlet 134. An outlet body 154 forms part of the nozzle body 161 as shown in FIG. 25. The outlet body 154 includes a distal wall 173 and two sidewalls that are not shown. The nozzle body 161 accommodates a slider 162 that couples to an actuator pin 135. The actuator pin 135 couples the slider 162 to a slider cover 91. The slider cover 91 slides along the nozzle body 161 with the slider 162. The slider cover 91 passes through a compensating member 92 or, more specifically, a cammed slot 93 in the compensating member 92.

To move the slider 162 from the open position shown in FIG. 25 to a closed position where the gate 169 engages the distal wall 173 of the outlet body 154, the actuator pin 135 shifts to the left in FIG. 25. Leftward movement of the slider 162 results in the gate 169 engaging the distal wall 173 and further results in the slider cover 91 shifting to the left and causing the compensating member 92 to be raised upward or in the direction of the arrow 94. By withdrawing a portion of the compensating member 92 from the nozzle body 161 as the nozzle 133 is closed, liquid near of the nozzle outlet 155 will be drawn towards the available volume created by the withdrawing compensating member 92. As a result, any drop or residual liquid disposed at or near the nozzle outlet 155 upon closure of the slider 162 results in that liquid being drawn upward into the through passageway 95, thereby avoiding any dripping of liquid after the slider 162 is shifted to a closed position. Conversely, when the nozzle 133 is opened, the gate 169 moves away from the wall 173 thereby increasing the available volume at the nozzle outlet 155. Further, as the piston cover 91 moves to the right in FIG. 25, the engagement of the cammed slot 93 and the piston cover 91 causes the compensating member 92 to drop downward and into the passageway 95, thereby causing liquid to fill the nozzle outlet 155. By balancing the loss of volume at the nozzle outlet 155 with the volume of the compensating member 92 that is withdrawn during closing of the nozzle 133, any dripping of residual liquid in the nozzle outlet 155 when the nozzle 133 is closed is avoided. Similarly, by balancing the gain in volume at the nozzle outlet 155 with the loss of volume when the compensating piston 92 drops into the passageway 95 when the nozzle 133 is opened, fresh liquid fills the nozzle outlet 155 and presents a liquid surface that is flush with the nozzle outlet 155. Seal members 96, 97 may be disposed between the nozzle body 161 and the slider cover 91 and seal members 98, 99 may be disposed between the slider 162 and the nozzle body 161 as shown in FIG. 25.

FIG. 26 illustrates another nozzle 233 that also includes a nozzle body 261 and a slider cover 291. A compensating piston 292 may be coupled directly to the slider cover 291 and, in the embodiment illustrated in FIG. 26, is partially disposed in the inlet 234 to the nozzle body 261. When the slider 261 and nozzle body 291 are shifted to the left in FIG. 26 to arrive at a closed position with the gate 269 engaging the distal wall 273, the compensating member 292 is partially withdrawn from the inlet 234 or nozzle body 261 thereby creating available volume, or a slight vacuum or suction which will draw liquid upward from the nozzle outlet 255 and into the through passageway 295. Conversely, when the nozzle 233 is opened, the increased volume at the nozzle outlet 255 is balanced by the decrease in volume caused by the compensating member 292 reentering the inlet 234 or passageway 295. By balancing the increase in volume at the nozzle outlet 255 with the decrease in volume caused by the compensating member 292 reentering the inlet 234 or passageway 295, the nozzle outlet 255 becomes charged with fresh liquid with a surface that is flush with the nozzle outlet 255. Like the nozzle 133 shown in FIG. 25, the actuator pin 235 couples the slider cover 291 to the slider 262 and seal members 296, 297 may be disposed between the nozzle body 261 and the slider cover 291 and seal members 298, 299 may be disposed between the slider 262 and the nozzle body 261.

FIG. 27 illustrates yet another nozzle 333 without a slider cover 91 or 291. The nozzle body 361 includes an inlet 334 and an outlet 363 that couples to an outlet body 354. The outlet body 354 includes a distal wall 373 for sealingly engaging the gate 369 of the slider 362. The slider 362 includes a compensating member 392. The compensating member 392 partially extends out of the outlet body 371 as the slider 362 moves to the closed position. By pushing a portion of the compensating piston 392 out of the through passageway 395 when the nozzle 333 is closed, available volume in the passageway 295 is created that draws any residual liquid upward from the nozzle outlet 355 and into the through passageway 395 without dripping. Conversely, when the nozzle 333 is opened, the gate 369 moves away from the wall 373, thereby creating available volume for liquid that is balanced by the compensating member 392 reentering the passageway 395. As a result, liquid enters the nozzle outlet 355 as the nozzle 333 is opened, charging the nozzle outlet 355 with liquid that presents a surface that is flush with the nozzle outlet 355. Again, an actuator pin 335 couples to the slider 362.

Figure 28:
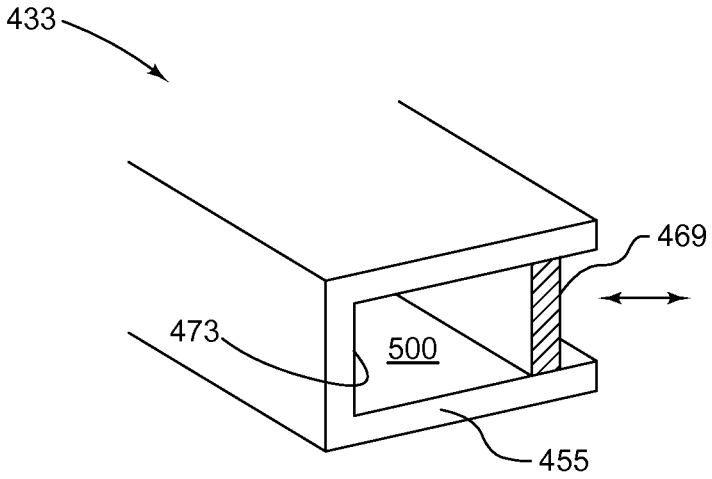
FIG. 28 is an end view a disclosed nozzle outlet illustrating a liquid surface that is flush with the nozzle outlet when the gate is open.
Figure 29:
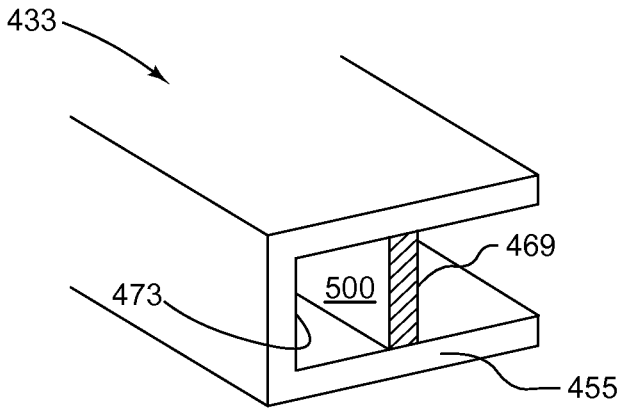
FIG. 29 is an end view the nozzle outlet shown in FIG. 28 illustrating the liquid surface that is flush with the nozzle outlet when the gate is partially open or closed.
Figure 30:
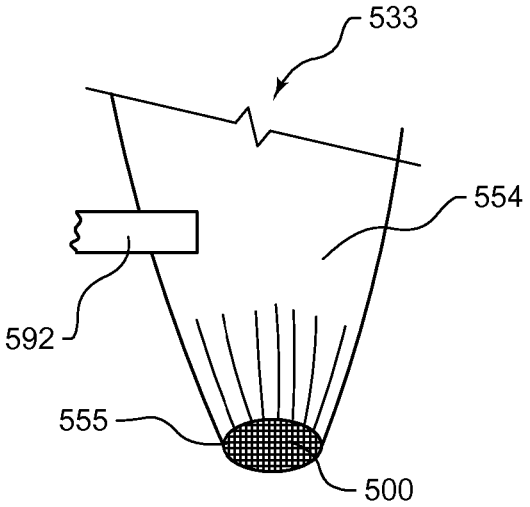
FIG. 30 is a plan view of an iris-type nozzle outlet equipped with a volume compensating member that is in an open position and illustrating a liquid surface that is flush with the nozzle outlet.
Figure 31:
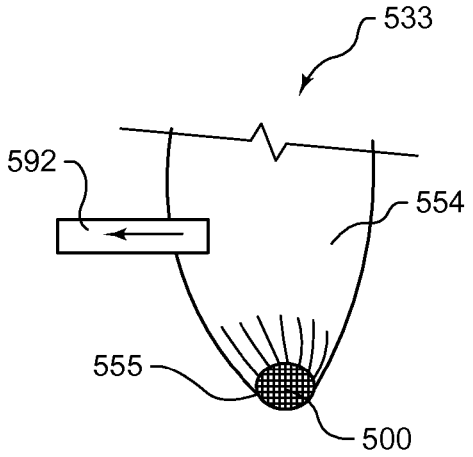
FIG. 31 is a plan view of the iris-type nozzle outlet of FIG. 30 that is in a partially open position and illustrating the liquid surface that remains flush with the nozzle outlet.
Figure 32:
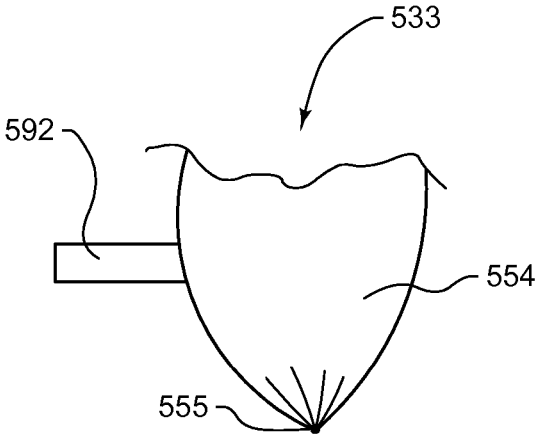
FIG. 32 is a plan view of the iris-type nozzle outlet of FIGS. 30-31 that is in a closed position.

The nozzles 33, 33*b*, 133, 233, 333 include generally rectangular nozzle outlets 55, 55*b*, 155, 255, 355. The creation and maintenance of a "flush" liquid supply at a nozzle outlet 455 as a gate 469 moves towards or away from a closed position is illustrated schematically in FIGS. 28-30. As discussed above, referring to FIGS. 28-29, when the gate 469 moves towards the wall 473 to close the nozzle 433, liquid disposed in the outlet 455 begins to be drawn away from the outlet 455 and into the nozzle 433, without dripping and while maintaining a supply of liquid at the nozzle outlet 455 that presents a flush surface 500 with the nozzle outlet. Conversely, as the gate 469 moves away from the wall 473 towards a fully open position, liquid reenters the nozzle outlet 455 and the flush surface 500 of the liquid at the nozzle outlet 455 is maintained.

Figure 33:
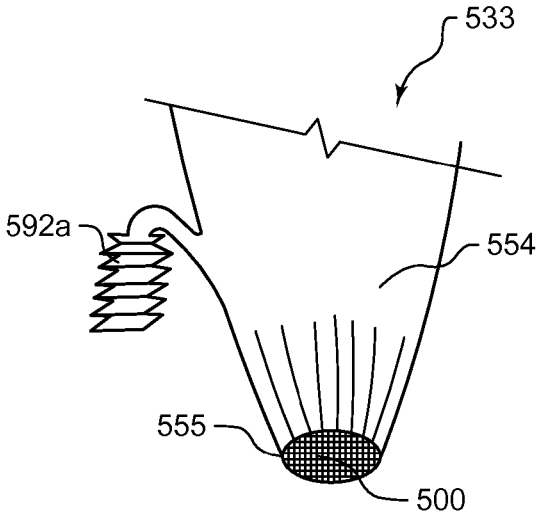
FIG. 33 is a plan view of an iris-type nozzle outlet equipped with a volume compensating element in the form of a bellows.

However, this disclosure is not limited to rectangular or 4-walled nozzle outlets. For example, FIGS. 30-33 illustrate a nozzle 533 with a nozzle outlet 555 that is of the iris-type. As the nozzle outlet 555 is closed (FIG. 32), the compensating member 592 is withdrawn from the outlet body 554. This action draws liquid up into the outlet body 554 without dripping. Similarly, as the nozzle outlet 555 is opened, the compensating member 592 reenters the outlet body 554 causing liquid to charge the nozzle outlet 555 as it is opened and as discussed above the other embodiments. FIG. 33 shows an alternative to a compensating member in the form of a bellows 592*a*. Various alternatives to a compensating member 592 other than a bellows 592*a* will be apparent to those skilled in the art.

INDUSTRIAL APPLICABILITY

An actuation system for a liquid dispenser 30 is shown and described. The liquid dispenser 30 includes a stationary and circular array of nozzles 31 that may be individually actuated by upwardly protruding actuator pins 35. The actuator pins 35 may be actuated one at a time. Two stationary motors 39, 41 are used to rotate an actuator implement 48*a* around the circular array of nozzles 31 until a selected nozzle 33 is arrived at. Then, the actuator motor 41 is activated again which results in rotation of the actuator implement 48*a* which engages the actuator pin 35 of the selected nozzle 33 thereby partially or fully opening the nozzle 33 or fully closing the nozzle 33.

The two motors 39, 41 of the actuation system may be mounted on a stationary table or platform 38. Because the circular array of nozzles 31 is stationary, all motors used to drive the liquid dispenser 30 remain stationary, resulting in a simplified design with less moving parts and less problems associated with motors mounted on moving parts or platforms.

Improved nozzles 33, 133, 233, 333, 433, 533 are also disclosed in FIGS. 5A-7A, 5B-7B and 25-27 respectively, which include sliders 62, 62*b*, 162, 262, 362 that include gates 69, 69*b*, 169, 269, 369, 469 that move from a fully closed position through multiple open positions as well as a fully open position while maintaining a supply of liquid at the nozzle outlets 55, 55*b*, 155, 255, 355, 455, 555 that remains flush with the outlets 55, 55*b*, 155, 255, 355, 455, 555 and that does not drip. The extent to which the gates 69, 69*b*, 169, 269, 369 are opened can be controlled by the disclosed actuator system 20 and therefore the output flow may controlled. The disclosed nozzles 33, 33*b*, 133, 233, 333 are designed with a sniff back function that prevents dripping when the nozzles 33, 33*b*, 133, 233, 333, 433, 533 are being closed and a reverse sniff back function that maintains a liquid surface 500 at the nozzle outlets 55, 55*b*, 155, 255, 355, 455, 555. The disclosed nozzles 33, 33*b*, 133, 233, 333, 433, 533 are not prone to plugging or clogging.

What is claimed:

1. A nozzle for a liquid dispenser, the nozzle comprising:

a hollow nozzle body including a nozzle body inlet and an outlet body with a slider passageway extending therebetween, the outlet body terminating at a nozzle outlet, the nozzle outlet including a distal wall, a slider including a slider body coupled to a gate, the slider body slidably accommodated in the slider passageway, the gate slidably accommodated in the outlet body and the nozzle outlet, the gate engaging the distal wall when the slider shifts to a fully closed position, the nozzle outlet in communication with the passageway as the slider and gate moves from the fully closed position to an open position, and a volume compensating element in communication with the passageway that decreases an available volume in the passageway for accommodating liquid as the gate is opened and that increases the available volume in the passageway for accommodating liquid as the gate is closed.

2. The nozzle of claim 1 wherein nozzle body and outlet body are separate components and the nozzle body includes a nozzle body outlet and the outlet body connects to a collar that is sealably and mateably received in the nozzle body outlet.

3. The nozzle of claim 2 wherein the compensating element is the slider body.

4. The nozzle of claim 2 wherein the compensating element is a compensating member slidably coupled to the slider passageway for increasing and decreasing the available volume for accommodating liquid.

5. The nozzle of claim 2 wherein the compensating element is an accumulator in communication with the slider passageway for increasing and decreasing the available volume for accommodating liquid.

6. The nozzle of claim 2 wherein the slider couples to a slider cover that is disposed exterior of the nozzle body, the slider cover engaging the compensating element, the compensating element being a compensating member extending through an opening in the nozzle body and into the slider passageway, the slider cover pulling the compensating member at least partially out of the slider passageway as the slider is moved towards the fully closed position and the slider cover pushing the compensating member into the slider passageway as the slider is moved towards the fully open position.

7. A nozzle for a liquid dispenser, the nozzle comprising:

a nozzle body including an inlet, an outlet and a passageway for slidably accommodating a slider, the slider including a gate, the slider including a reduced diameter portion that is disposed between the inlet and outlet when the gate is in an open position, the outlet including a wall that engages the gate when the gate is in a closed position, the passageway accommodating a distal end of the slider when the slider is in the open position, said distal end of the slider at least partially withdrawing from the passageway when the slider is moved towards a closed position thereby creating additional volume in the passageway for receiving liquid from the outlet, said distal end of the slider at least partially reentering the passageway when the slider is moved towards an open position thereby reducing volume in the passageway and causing liquid to flow from the slider passageway to the outlet.

8. A nozzle for a liquid dispenser, the nozzle comprising:

a nozzle body including an inlet, an outlet and a passageway extending therebetween, the passageway slidably accommodating a slider, the slider including a slider body coupled to a gate, the outlet slidably accommodating the gate and including a wall, the gate sealably engaging the wall of the outlet when the slider shifts to a closed position, the passageway at least partially accommodating the slider body when the slider is in an open position, the slider body at least partially departing the passageway when the slider moves from the open position to a closed position thereby creating additional volume for receiving liquid from the outlet, and the slider body at least partially reentering the passageway when the slider moves from the closed position to an open position thereby reducing available volume in the passageway and causing liquid to flow from the passageway to the outlet.

* * * * *